United States Patent [19]

Brett

[11] 4,283,653

[45] Aug. 11, 1981

[54] HIGH EMISSIVITY FILAMENT FOR ENERGY CONSERVING INCANDESCENT LAMPS WITH INFRARED RADIATION RETURNING ENVELOPES

[75] Inventor: Jack Brett, Great Neck, N.Y.

[73] Assignee: Duro-Test Corporation, North Bergen, N.J.

[21] Appl. No.: 76,356

[22] Filed: Sep. 17, 1979

[51] Int. Cl.[3] ..... H01J 1/15; H01J 19/08; H01K 1/02

[52] U.S. Cl. ..... 313/341; 313/112; 313/344; 313/315

[58] Field of Search ..... 313/315, 341, 344, 112

[56] References Cited

U.S. PATENT DOCUMENTS

| | | | |
|---|---|---|---|
| 2,126,155 | 8/1938 | Van Dyck | 313/341 X |
| 2,218,345 | 10/1940 | Spaeth | 313/344 X |
| 2,859,369 | 11/1958 | Williams et al. | 313/112 |
| 3,210,589 | 10/1965 | Mason | 313/341 X |
| 3,662,208 | 5/1972 | Ohmae et al. | 313/112 |
| 4,017,758 | 4/1977 | Almer et al. | 313/112 |

*Primary Examiner*—Saxfield Chatmon, Jr.
*Attorney, Agent, or Firm*—Darby & Darby

[57] ABSTRACT

An incandescent lamp having a coating thereon which returns infrared energy to the filament to decrease the amount of power consumed by the lamp in order to maintain the filament at a predetermined operating temperature has a predetermined fractional spacing between turns which results in an emissivity greater than 0.5 at 2,000° K. The filament also has a predetermined length to diameter ratio to make it compact and thereby improve its emissivity and the capture of the reflected infrared radiation and to reduce aberration losses. The filament can be a coiled coil or triple coiled coil and can be stabilized by secondary recrystallization.

12 Claims, 5 Drawing Figures

HIGH EMISSIVITY FILAMENT FOR ENERGY CONSERVING INCANDESCENT LAMPS WITH INFRARED RADIATION RETURNING ENVELOPES

BACKGROUND OF INVENTION

A conventional incandescent lamp utilizes a filament of a refractory material, such as plain or doped tungsten which is electrically heated. When operated at and above the temperature at which the filament incandesces, it supplies visible wave length energy and energy in the infrared range. In a typical incandescent lamp, the infrared energy is radiated from the lamp and wasted as heat. The lamp filaments generally are of the helical coiled type, single coiled or coil-coiled, which are either mounted in a U-shaped arrangement or in an elongated horizontal or vertical mounting arrangement.

Incandescent lamps have been proposed which employ an infrared (IR) radiation reflective coating in combination with an optically shaped envelope to reflect IR energy back to the filament. The energy received by the filament raises its operating temperature and, therefore, decreases the amount of energy needed to heat the filament to its operating temperature. This results in a decrease in the total amount of power consumed by the lamp to produce the same amount of light output, thereby resulting in an energy saving.

In the design of a filament for a conventional incandescent lamp, reflected and returned infrared radiation plays no part in the design consideration. The design of such filaments for conventional lamps usually needs only the specification of parameters such as operating voltage, operating wattage, lumen per watt required, the operating temperature, and the desired operating life. From this, the resistance of the filament is calculated and the filament is constructed.

It has been found that conventional filaments, for example, those of the coiled coil-type for lamps of 100 watts or below, are unsuitable in an incandescent lamp which utilizes a radiation reflective coating. Such filaments have a relatively large length/diameter ratio (about 19:1 for a 100 watt filament) and, due to the extended length, there is a large temperature gradient between the central portion of the filament and its ends. This gradient limits the life of the filament to that characteristic of the hot central portion while simultaneously limiting the light output to a value characteristic of the lower, mean temperature value of the filament. The temperature gradient is greatly reduced in the non-IR reflecting lamp environment where it does not essentially alter the life-light output relationship.

SUMMARY OF THE INVENTION

In the design of the filament for incandescent lamp with an IR radiation reflective mechanism, it has been determined that the emissivity of the filament has a significant role to play in the energy conservation characteristics of the lamp. In addition, the physical geometry of the filament, which in some measure determines its emissivity, is important since filaments of larger diameter require less precise optical centering in order to be able to receive the IR radiation reflected from the return mechanism.

In accordance with the subject invention, an incandescent filament is provided for a lamp having an IR energy radiation return mechanism in the form of a reflective coating. The preferred embodiment of the filament is of the coiled coil-type or triple coiled coil having an emissivity of at least 0.5 at 2,000° K., a minimum diameter related to the diameter of the lamp envelope so as to maximize impingement of the reflected and returned IR radiation onto the filament and to minimize the filament centering problems. The filament also has a selected body length/diameter ratio to maximize the emissivity.

OBJECTS OF THE INVENTION

It is, therefore, an object of the present invention to provide a filament for an incandescent lamp having an IR radiation reflective coating.

A further object is to provide a filament for an incandescent lamp of the type having an IR reflective coating in which the emissivity of the filament is optimized.

Another object is to provide a filament for an incandescent lamp with an IR reflective coating having a selected length/diameter ratio so as to make the filament compact and thereby augment the capture of radiation returned from the coating which impinges upon the filament.

Other objects and advantages of the present invention will become more apparent upon reference to the following specification and annexed drawings in which.

Figure 1:
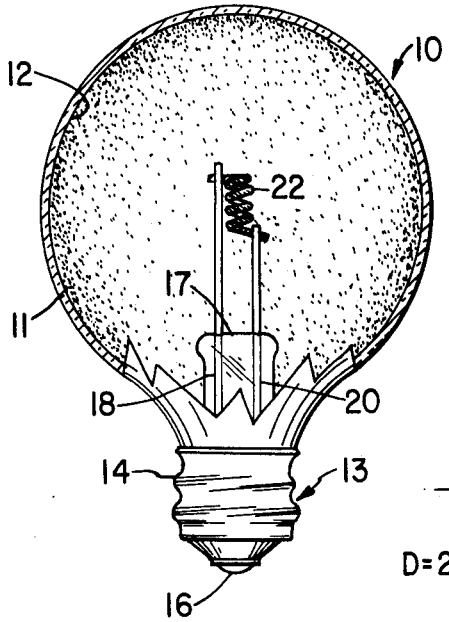
FIG. 1 is an elevational view of an incandescent lamp in accordance with the invention.

FIG. 1 shows a type of incandescent lamp 10 made in accordance with the subject invention. The lamp includes an envelope 11 which is preferably of a desired optical shape, the illustrative shape being shown as being spherical except at the base portion. Other suitable optical shapes can be used, for example, ellipsoidal and hyperboidal. The lamp has a mechanism for returning IR energy produced by the filament upon incandescence to the filament. In the preferred embodiment, the lamp has coated on the major part of its spherical surface, either internally or externally, a coating 12 which is highly transparent to visible wavelength energy and highly reflective to IR wavelength energy. A suitable coating is described in U.S. Pat. No. 4,160,929, granted on July 10, 1979 and which is assigned to the same assignee.

A filament 22, which is described in greater detail below, is mounted on a pair of lead-in wires 18, 20 held in an arbor or stem, 17. The lead-in wires 18, 20 are brought out through the arbor to electrical contacts 14, 16 on a base 13. Arbor 17 also has a tubulation (not shown) through which the interior of the lamp envelope is exhausted and filled, if desired, with a gas. Suitable gases are, for example, argon, a mixture of argon-nitrogen, or a high molecular weight gas, such as krypton or a mixture of krypton-nitrogen. The lamp also can be operated as a vacuum type.

When voltage is applied to the lamp, the filament 22 incandesces and produces energy in both the visible and the IR range. The exact spectral distribution of the filament depends upon its average operating temperature, which in turn depends upon the resistance of the filament. Typical filament operating temperatures are in the range of from about 2650° K. to about 2900° K., although operation at a temperature as low as 2000° K. and as high as 3050° K. can be used. As the filament operating temperature decreases, the spectral distribution shifts further to the red, i.e. it produces more infrared energy.

The coating 12, in combination with the optical shape of the lamp, serves to reflect back to the filament a substantial, and preferably as large a portion as possible, i.e. about 85% or more, of the IR energy produced by the filament. When the energy is reflected back to the filament, it increases its operating temperature and thereby decreases the power (wattage) required to operate the filament at this temperature. This serves to conserve energy.

The design of the filament for the IR radiation returning envelope requires special characteristics which depend upon the expected filament performance. There are generally three physical constraints which must be considered in the design of the filaments. First the filament must be designed for maximum emissivity to maximize energy savings. By Kirchoff's Law, the emissivity and absorbtivity of a radiator, such as a filament, are equal. High emissivity implies high absorbtivity such that a large proportion of the reflected radiation will be used to heat the filament. This is considered in greater detail below.

As a second consideration, the filament must be as large in diameter as practicable to minimize the effects of miscentering in the IR reflective environment. That is, the filament is preferably located at the optical center of the lamp envelope. Consequently, the smaller the diameter of the filament, the harder it will be to center. For example, in a conventional 100 watt lamp, the incandescent filament has a diameter of about 1.0 mm. If it is miscentered by 0.5 mm in an ideal spherical reflector, then about 50% of the emitted and reflected radiation will not reimage on the filament on the first reflection. While it will reimage on the second or subsequent reflection, some of the energy may be lost due to absorption in the envelope wall. Consequently, the effect of any given miscentering is minimized if the filament is made with as large a diameter as possible.

As the third consideration, the filament should have as small a length/diameter ratio as possible to minimize aberration losses from the reflecting environment. Further, the shortest possible length is required to minimize the gas losses of the filament. Compared to a standard incandescent lamp filament, an IR reflecting environment can reduce the energy required to attain filament operating temperature up to about 60%.

It is also desired to minimize the filament length due to the large temperature gradient between the center of the filament and its end ends in a reflecting environment. For example, it can be shown that an ordinary 100 watt 120 volt incandescent filament having a 1.0 mm outer diameter, 29.5 mm length, exhibits a temperature gradient of 125° C. in normal operation and 900° C. when heated to the comparable average operating temperatures in a 3" diameter reflecting silvered spherical closure. In contrast, a compact 1.6 mm outer diameter filament 13 mm long exhibits a similar 125° C. gradient in a clear (no IR reflective coating) and a gradient of less than about 600° C. in the same spherical reflector. Aberration losses at the ends of the filament are believed to be responsible for the temperature gradient which is minimized by using a compact filament. While such temperature gradients are excessive for normal lamp operation, they can be reduced by suitable design of the reflector.

Figure 2:
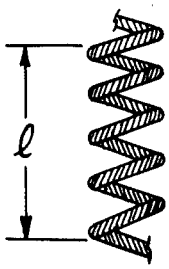
FIG. 2 is a view of a portion of a coiled-coil coiled filament.

As discussed in the first consideration, the filament should have as high an emissivity E as possible since this means that is also has a high absorptivity to IR energy. FIG. 2 shows a coiled-coil filament 22 made in accordance with the invention in which helically coiled filament wire is wound into a helical, cylindrical coil configuration.

In primary coil of the filament is the straight wire that was originally helically coiled. The secondary coil is the resulting filament coil formed by helically winding the primary coil.

Figure 3:
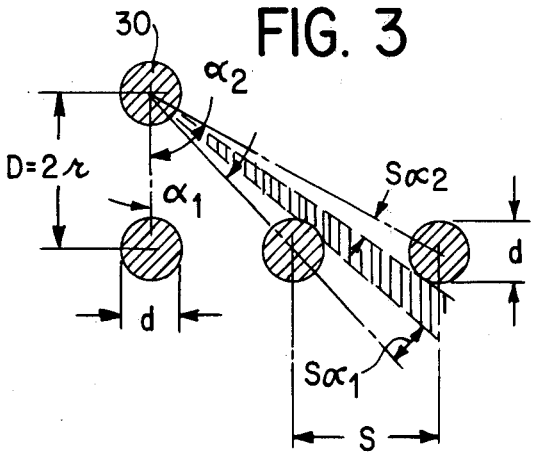
FIG. 3 is a cross-section of a portion of a single coil filament illustrating certain of the radiation characteristics of the energy produced by the filament.

FIG. 3 is a cross-section of a filament coil. The overall filament is a helically wound cylindrical body. When coiled, a section of the winding can be modeled as an infinite number of cylinders placed end to end.

Figure 3A:
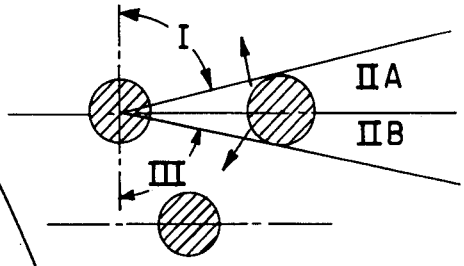
FIG. 3A is a diagram illustrating the travel of the rays.

In FIGS. 2, 3 and 3A, several dimensions are noted:

l = the overall length of the cylinder

R = The radius from the center of the cylinder to the midpoint of the coil.

D = the distance between adjacent turns.

d = the diameter of the wire of the coil s = the fractional spacing between adjacent turns, where $s = 1 - d/D$ In the filament, $E_o$ is the emissivity of the bare wire forming the primary coil and E is the emissivity of the complete coiled filament.

When the filament incandesces and produces radiant energy, p is the probability that a ray emitted from the interior of the coil will escape from between the turns. For a flat ribbon coil of fractional spacing s, p would be equal to s. In the cylindrical coil shown, the rays emitted from the outside portions of the coil turns escape but the escape probability of the rays produced from the interior is complex.

It has been found that the factors which determine filament emissivity are the fractional spacing s between turns of the coil and the ratio of the distance D between the centers of adjacent turns to the filament radius R, namely D/R. Another factor is the ratio of the radius R of the coil to its length l.

Referring to FIG. 3 and FIG. 3A, the following explains the relationship between various dimensions of the filament and its emissivity. The analysis is given for a single coil but can be iterated to hold for the primary and secondary coil of a coiled coil filament or for a triple coiled coil.

In any portion of the helical wire, rays will be emitted in all directions. The radiation P from any cross section of a coil turn is divided into three regions. These being:

1. Region I—radiation travels outwardly and directly escapes.
2. Region II—radiation strikes an adjacent coil before escaping. Only one reflection is assumed before escaping.
3. Region III—radiation travels inwardly and is trapped before escaping.

Each of these regions are shown by the corresponding numerals on the drawing.

Region II is subdivided into IIa, where reflection leaves the ray outside the coil and IIb were reflection leaves the ray within the coil.

The trapping of radiation in Region III must take into account the shape of the enclosing coils. The helical coils can be approximated by a series of evenly spaced cylinders. It is assumed that the radiation from the coil travels uniformly outward in cylindrical fashion and that the coil is at a uniform temperature T. The surface area of the coil is $A_s$ and $\delta$ designates the Stefan-Boltzman constant. The power output can be given as:

$$P = \sum_i P_i = E_o A_s \delta T^4 \frac{\sum_i \theta_i}{\pi} q_i \quad (1)$$

where $q_i$=is the probability of escape from region i whose angular width is $\theta_i$.

The probability of escape from Region I is unity so $q_i=1$. The probability of Region II is $q_2=(1-E_o)$ 1 where $(1-E_o)$ is the average fraction reflected. The probability of escape from the interior Region III is $q_4$ and can be shown to be $$q_4 = p \frac{1}{1-(1-E)(1-p)} \quad (2)$$

The probability of $q_3$ is $(1-E_o)$ $q_4$. It can be shown that the escape probability varies with the angle $\alpha$ since the projected opening decreases with increasing $\alpha$. The escape probability per unit angle at $\alpha_n$ is:

$$p(\alpha_n) = \frac{(\alpha_n - \alpha_{n-1}) - (\delta\alpha_n + \delta\alpha_{n+1})}{(\alpha_n - \alpha_{n-1})} \quad (3)$$

The escape probability for a single pass of a ray is the average of $\rho(\alpha_n)$ over the angle $\pi/2-\theta$ and depends upon s. This probability can be computed. In general, as the fractional spacing s increases, the probability of escape as a function of s, p(e), also increases.

It can be shown that the radiation output P from the lamp is $$P = E_o A_s \delta T^4 \left(\frac{i - 2E_o\theta}{\pi}\right)\left(\frac{1+q_4}{2}\right) \quad (4)$$

The effective emmissivity E is defined from $$\rho = E A_c \delta T^4 \quad (5)$$

where $A_c$ is the area of an imaginary close fitting cylinder enclosing the coil.

From this it can be derived $$\frac{E}{E_o} = \pi(1-s)\sqrt{1+\left(\frac{D}{2\pi R}\right)^2}\left(\frac{1-2E_o\theta}{\pi}\right)\left(\frac{1+q_4}{2}\right) \quad (6)$$

Equation (6) shows that the emissivity of the coil is a function of the fractional spacing s. The analysis holds for the primary coil and can be iterated for a coiled-coil or for a triple coiled-coil.

Figure 4:
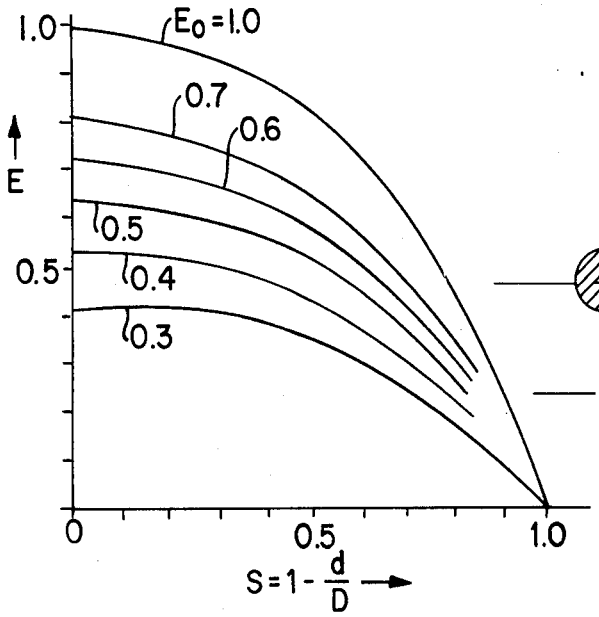
FIG. 4 is a graph showing the emissivity of a filament as a function of the spacing between turns.

FIG. 4 shows the relationship between the final emissivity E and the fractional spacing s for a number of filament wires of initial emissivity $E_o$ from between 0.3 to 1.0. It can be seen that as the fractional spacing decreases, i.e., the turns of the filament are brought closer together, the emissivity E increases.

From a practical point of view, there is a limit to which the fractional spacing can be decreased. This is caused by the fact that if the turns are brought too closely together, sagging due to creep causes the life of the filament to be reduced by shorting.

A filament for a conventional lamp has an emissivity of about 0.46. The filaments of the present invention have an emissivity in the range of from about 0.5 to about 0.8, at a temperature of above about 2000° K. It has been shown that this range of increased emissivity has produced energy savings in the range of about 5% to about 20% on an IR reflective type lamp as compared to a standard filament having an emissivity of about 0.46. Above an emissivity of 0.7, the turn spacing becomes so close that there is a problem of sag, even with a high temperature exposure to promote recrystallization and grain growth. The higher emissivities can be achieved by making the fractional spacing of the turns of the coil in the range of from about 0.2 to about 0.3. The same fractional spacing can be used for coiled coils or for triple coiled coils. That is, once the fractional spacing is determined for the primary coil to yield maximum emissivity, the same fractional spacing is preferably used in making the coiled-coil or triple coiled coil.

As described above, it is preferred that the filament for an IR reflecting lamp be made with as large a diameter as possible to minimize the centering problem where the filament is to be located at the optical center of the envelope. In a typical filament for a conventional 100 watt lamp, the diameter is about 1.0 mm. This diameter is small enough to provide difficult centering problems with respect to high speed manufacture. Consequently, it is desired to increase the diameter. Here also, the maximum diameter is limited by the sag problem. In such a lamp it has been found that a substantial improvement is obtained if the outer diameter of the coiled coil has a minimum diameter of about 1.3 mm. This gives a 30% greater margin for centering error. In such a lamp, the upper limit for the diameter of the coiled-coil is about 1.6 mm. Above this dimension a considerable problem of sag is encountered for the diameter of the filament wire used.

Centering problems are greater in lower wattage lamps since the filament diameters are smaller. Centering problems are less severe in larger diameter lamps since large diameter filaments are used. Also, problems relating to sag are less in the higher watage lamps since the wire size is greater.

It is preferred that, as compared to filaments for conventional lamps of the same wattage, that the filament diameter be increased by about 30% to about 60% for lamps to a wattage up to about 500 watts, which have a filament diameter of about 0.25–0.375 inches. Above this diameter, compacting the filament (reducing the length/diameter ratio) is useful for increasing emissivity, but mechanical centering is not a limitation. In low voltage lamps, where heavier filaments are used, compacting the filament is still beneficial in an IR radiation returning environment.

The same dimensions for diameter also hold for a triple coil filament.

Also, as discussed above, the filament should be made compact, lengthwise, to reduce end losses, gas losses, and the temperature gradient. A filament for a conventional 100 watt lamp is about 19 mm long. This produces an excessive gradient insofar as an IR reflective lamp is concerned.

As in the case of emissivity and diameter, the minimum length of the filament is limited by sag. The upper limit is determined by the temperature gradient that can be tolerated. It has been found that for a lamp which would produce about the same lumen output as a conventional 100 watt lamp in a size G25 bulb that range of lengths of between about 11 mm to about 15 mm is acceptable. It should be understood that stretching the length of the filament decreases the emissivity since the fractional spacing is increased.

In general, the preferred embodiment filament for the IR reflecting lamp is either coiled-coil or triple coiled and is linear. Making the filament U or C-shaped further increases the problem of centering and maximizing the amount of IR which is returned to the filament. The filament is preferably vertically mounted, as shown in FIG. 2, although it can be mounted horizontally. Support wires can be provided for the filament to reduce movement during shipping and to enhance sag resistance.

The preferred embodiment is large enough in diameter to minimize miscentering problems and short enough so that aberration losses are not excessive. Body length to diameter ratios of from between about 5 to 1 and 13 to 1 have been found to be satisfactory.

It is also preferred that after the filament has been formed, but before it is sealed into the lamp envelope, that is to be heated to a temperature which causes secondary recrystallization of the structure. This increases the strength of the filament and reduces the sag problem. To accomplish this, the filament is heated in a vacuum or in a protective atmosphere, for example argon, to above 2000° C.

The relationships of emissivity and filament length to diameter apply to lamps of all wattages in an infrared reflecting environment although the preferred filament has been described as being compared to a conventional 100 watt lamp, and such preferred filament is to be used in an IR reflecting lamp to produce substantially the same light output as a conventional 100 watt lamp but at a reduced energy consumption.

What is claimed is:

1. A filament for an incandescent lamp of the type which reflects infrared energy produced by the filament back to the filament to reduce the power required to maintain the filament at a predetermined operating temperature said filament comprising a coil of a wire of refractory metal having an emissivity of at least 0.5 at an operating temperature of above about 2000° K.

2. A filament as in claim 1 wherein the diameter of the coil is at least about 1.3 mm.

3. A filament as in either of claims 1 or 2 wherein the ratio of the length of the filament to its diameter is in the range of from between about 5 to 1 to between about 13 to 1.

4. A filament as in either of claims 1, 2 or 3 wherein the fractional spacing between the turns of the primary coil is in the range of from about 0.2 to about 0.3.

5. A filament as in claim 1 wherein the coil of the filament is wound as a coiled coil and the fractional spacing between the turns of the primary coil is in the range of from about 0.2 to about 0.3.

6. A filament as in claim 1 which has been stabilized by subjecting it to heating after winding at a temperature which causes secondary recrystallization.

7. A filament as in claim 2 which has been stabilized by subjecting it to heating after winding at a temperature which causes secondary recrystallization.

8. A filament as in claim 3 which has been stabilized by subjecting it to heating after winding at a temperature which causes secondary recrystallization.

9. A filament as in claim 4 which has been stabilized by subjecting it to heating after winding at a temperature which causes secondary recrystallization.

10. An incandescent electric lamp comprising:

an envelope of light transmissive material, a filament mounted within said envelope which produces energy in the visible and infrared ranges when heated to incandescense, said filament having a length which is substantially less than the dimension of the major axis of the envelope, means for supplying electrical current to said filament to heat it to incandescense, means on said envelope for transmitting energy in the visible range and for reflecting energy in the infrared range produced by said filament, said envelope being shaped such as to reflect by said reflecting means the infrared range energy from all parts of the envelope back onto said filament, said filament formed by a coil of refractory metal having an emissivity of at least 0.5 at an operating temperature of about 2000° K.

11. An incandescent electric lamp as in claim 10 wherein said filament is elongated with the ratio of the length of the filament to its diameter being in the range of from between about 5 to 1 to between about 13 to 1.

12. An incandescent electric lamp comprising:

an envelope of light transmissive material, a filament mounted within said envelope which produces energy in the visible and infrared ranges when heated to incandescense, said filament having a length which is substantially less than the dimension of the major axis of the envelope, means for supplying electrical current to said filament to heat it to incandescense, means on said envelope for transmitting energy in the visible range and for reflecting energy in the infrared range produced by said filament, said envelope being shaped such as to reflect by said reflecting means the infrared range energy from all parts of the envelope back onto said filament, said filament formed by an elongated coil of refractory metal having a ratio of the length of the filament to its diameter in the range of from between about 5 to 1 to between about 13 to 1.

* * * * *